US006987452B2

(12) United States Patent
Yang

(10) Patent No.: US 6,987,452 B2
(45) Date of Patent: Jan. 17, 2006

(54) IBOX WITH HOME DELIVERY AUTO-RECEIPT SYSTEM

(76) Inventor: Sunney Yang, 90 Forest Ave., Hershey, PA (US) 17033

( * ) Notice: Subject to any disclaimer, the term of this patent is extended or adjusted under 35 U.S.C. 154(b) by 58 days.

(21) Appl. No.: 10/712,080

(22) Filed: Nov. 13, 2003

(65) Prior Publication Data

US 2005/0104730 A1 May 19, 2005

(51) Int. Cl.
*G08B 13/14* (2006.01)

(52) U.S. Cl. ..... 340/569; 340/531; 340/538; 232/36

(58) Field of Classification Search ..... 340/569, 340/531, 538, 540, 568.1; 232/34, 36, 17
See application file for complete search history.

(56) References Cited

U.S. PATENT DOCUMENTS

| | | | | |
|---|---|---|---|---|
| 3,935,994 | A * | 2/1976 | Darvishian | 232/36 |
| 5,917,411 | A * | 6/1999 | Baggarly | 340/569 |
| 6,462,659 | B1 * | 10/2002 | Schuette | 340/569 |
| 2002/0024438 | A1 * | 2/2002 | Roberson | 340/569 |

* cited by examiner

*Primary Examiner*—Anh V. La
(74) *Attorney, Agent, or Firm*—Kao H. Lu

(57) ABSTRACT

This invention—iBOX, an intelligent multifunction mailbox, combines several technologies, such as video camera, remote programmable keypad, PN junction thermoelectric unit, powerline communication, wire or wireless communication and Internet together to provide a more secure, multi functional mailbox. It resolves several short comes of the traditional signature-required delivery operations.

61 Claims, 4 Drawing Sheets

IBOX WITH HOME DELIVERY AUTO-RECEIPT SYSTEM

FIELD OF THE INVENTION

This invention relates to an intelligent mailbox, more particular, this invention provides a multifunction intelligent mailbox with built-in video, audio, temperature control device, software and optional Internet, telephone communicating capability.

BACKGROUND

Traditional mailbox is a passive device where mailman drops regular mails. The traditional mailbox can't handle any registered mail. Nor the traditional mailbox can accept special delivery. A registered mail/package will require one of the residents of the designated address to sign a receipt before the delivery person can release the package. During the daytime, if the residents of a household have to go to work or go to school and no one is home that presents problem for both the delivery person and the mail/package receiver.

According to statistics data the volume of online purchases will steadily increase and accounts for at least 20% of total domestic purchase by year 2005, which the estimated on-line transaction amount is around US$1.1 trillions. Most merchants use a third party carrier to deliver their goods to the purchasers and require proof of delivery. Therefore, the home delivery services either from Post Office, UPS, Federal Express, or other commercial carriers will increase considerably every year. However, the traditional mailbox will not be able to handle the up raising commercial trend.

Furthermore, the trend to order ready to eat food through online is also getting popular in the ever fasting pace society. More and more people order frozen and pre-warmed foods from food stores or supermarkets. So far the food delivery service faces the same situation as the registered package has that requires someone at home to receive the delivery. Of course, the traditional mailbox won't be able to store and preserve those foods in safe and fresh condition even if we prepaid the food.

SUMMARY

There is a need for more intelligent multifunction mailbox to streamline delivery operations, to provide more security. Combining with a wire or wireless video camera, Internet, wireless communication, a programmable keypad and powerline communicating technology, the iBOX can overcome many shortcoming of the traditional mailbox. Moreover, through directly key in the keypad or remotely controlled, an iBOX can be operated and monitored either on-site or remotely to the access of these secured compartments and block out any unauthorized intrusion. Meantime, the built-in camera will record all accesses to the iBOX and be retreated back to date, hour, minute and second, such as the image of home delivery can be used as a proof of package delivery. The iBOX can store and preserve the delivered foods in a frozen or pre-warmed manner to keep its original taste and freshness.

BRIEF DESCRIPTION OF THE DRAWINGS

Following drawings with reference numbers and exemplary embodiments are referenced for explanation purpose.

DETAILED DESCRIPTION OF THE PREFERRED EMBODIMENTS

The core part of this invention is the "iBOX", an intelligent multifunction mailbox, which utilizes several existing technologies, such as video camera, the Internet, ISDN, Public Service Telephone Network (PSTN) or Wireless Communication to link merchants, the carriers and the end customers (an iBOX user) together.

Figure 1:
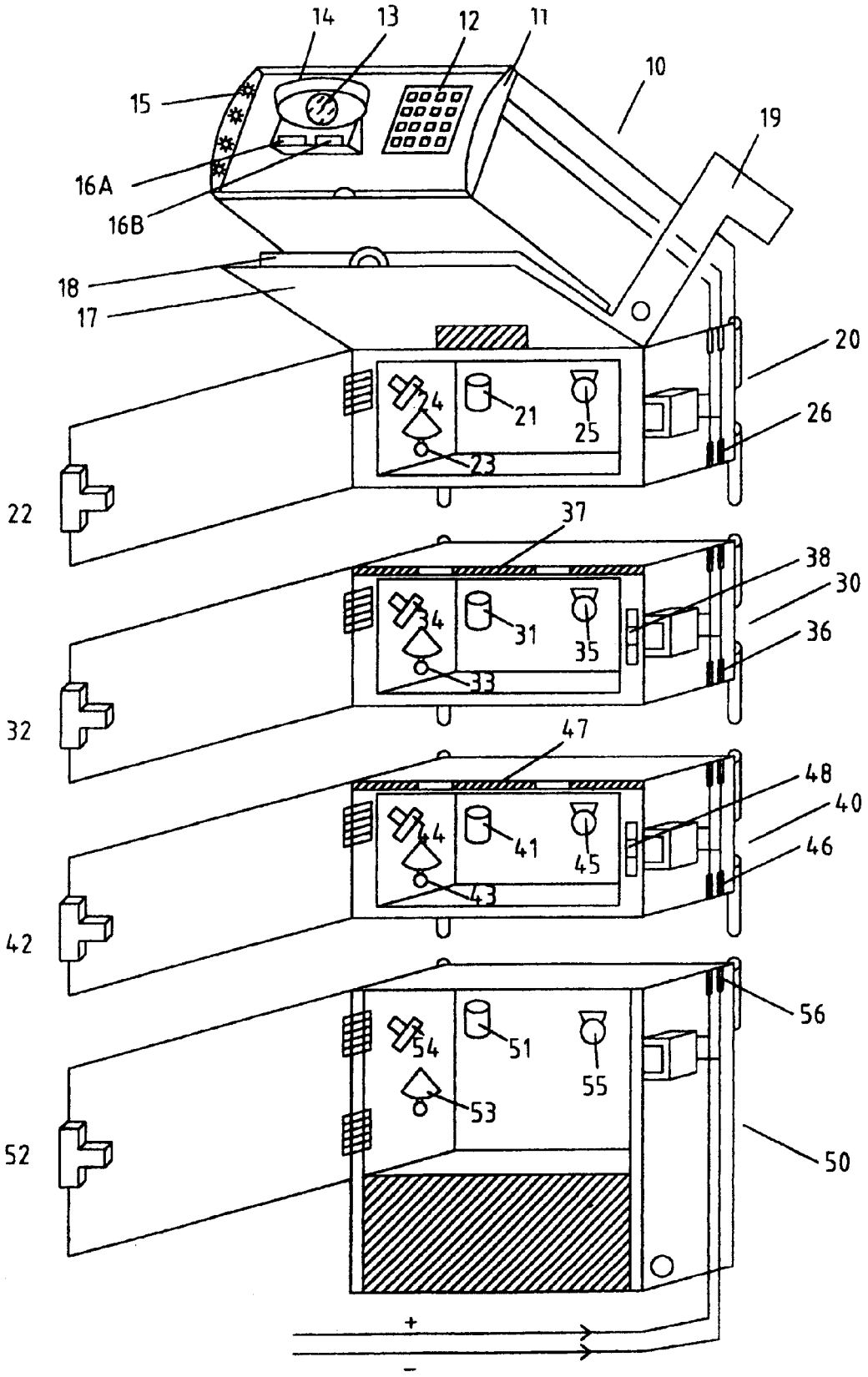
FIG. 1 illustrates the basic structure of an iBOX.

The "iBOX" can be a tower style having a plurality of modularized stackable compartments, and the iBOX can be a standalone model, a home PC-based model or an Internet-based model. FIG. 1 illustrates an example of the iBOX common basic design. The top compartment 10 is for regular mail. The second compartment of the iBOX is the registered mailbox compartment 20, the third compartment is a frozen food compartment 30, the fourth section is a pre-warmed food compartment 40, and the fifth compartment 50 is for large package. The frame of this iBOX is made of FRP or other tough material to protect UV, snow and resist impact, and the whole construction is a waterproof one. Because the tower configuration itself is flexible and modularized, a user can select different compartments for his customized iBOX configuration, such as that a user may use two large package compartments without any frozen or hot food compartment in his iBOX or an iBOX user may not want the large package compartment but all other compartments.

If the iBOX is installed directly on the ground, then there is a water proofed base stand with an inlet for the power line or other needed wires to come in from outside. This "iBOX" can be installed almost anywhere as long as it has access to electricity, it could be at the curb of the house nearby the lamp post, or at the front gate close to the lighting fixture. As an alternative, the iBOX can also be installed as a wall mount unit, which the iBOX can be embedded within the wall inside the house, and has a doorbell push button on it.

On the top of the iBOX is the control panel 11, which includes a programmable keypad 12, a first video camera 13 which has a motion sensor inside, an automatic lens shelter door 14 which can be driven by a DC motor to normally keep first video camera 13 closed, and the four LED indictor lights 15A–15D.

The programmable keypad 12 mainly is used for users to key in access password to unlock corresponding compartment's door, as well as the shelter door 14. However, an optional personal identification card reader can be embedded to the keypad, where requires password plus a valid personal identification card to open the locked compartment door. Underneath the video camera 13 there are two slots for USB interface 16A, 16B to connect with plug-in flash memory module or any other memory storage device. The lens shelter door 14 protects the camera as well as the two USB interface slots underneath from dust and unwanted invasion. There is a way to use a fixed transparent glass door to protect the first video camera 13, instead of using a movable shelter door 14. In this case, there is no motion sensor inside the camera, the voice/video recordings will be triggered only when a correct password is keyed in, or a doorbell button is pushed. The four LED indicator lights 15A–15D indicate the occupancy status of its corresponding compartment of the box, they are mounted on an angled panel that does protrude out enough, so that through the first video camera 13 a user can monitor the status of these four LEDs 15A–15D to determine if there is item in the monitored compartment.

For the iBOX example shown in FIG. 1, there will be at least four different passwords that each opens its corresponding compartment of the "iBOX". The passwords can be set by the iBOX user himself from the keypad 12, from a home PC or remote host computer, or even from the cell phone, which can be re-programmed either on daily or weekly basis for safety concern.

The first compartment 10 of the iBOX is purposed for the regular incoming mails, of which have no need to go through video camera system to get evidence for delivery. It has an angled shape entrance, below is a hinged door 17, and on it has a pocket 18 on it. By pulling down the door 17 users can put his outgoing mail on the pocket 18, and then he pulls the mailbox handle 19 up to show there is mail for delivery. The mailman will pick up mail from the pocket 18, and throw in regular incoming mails those mails will be kept in the compartment 20, which has lock on it.

The second compartment 20 is purposed for registered mail or smaller parcel shipment, which normally need a receipt for. Mailmen need to use password to open the compartment to put mails into. It has an occupancy sensor 21 inside, if there is a mail inside the second compartment, it will turn the first LED indicator light 15A on. The door lock 22 has a magnetic strike, which can be triggered to unlock the door lock by keying a valid password on the keypad 12. Once the door is opened, a bell-ring alarm 23 will be turned on to give warning about the opening door. Upon closing the door, a signal is sent to close the lens shelter door 14 and then stop the recording of the first camera 13. An optional auxiliary camera 25 inside the second compartment will take the still picture of the goods being put in, and transmits that to the system and store there as the evidence of goods being put-in even after the compartment door is closed. All wiring connections are made through a multiple position connector 26, which is built in the rear side of the compartment, that connects to the other compartments and the control panel when they are stacked together.

The third compartment 30 has thicker installation wall it also has an occupancy sensor 31, a door lock 32, a bell-ring alarm 33, a door switch 34, an optional auxiliary camera 35 and connector 36 as the second compartment. It also has a built-in PN-junction Ceramic Peltier Effect thermo electric heat pump 37 for temperature control. Once there is a package of food put inside, the occupancy sensor 31 will turn the LED Indicator 15B on, and it will also trigger the thermal switch 38 inside the compartment to turn on the PN junction thermoelectric unit 37 to cool down the temperature to 42 degree F. instantly and maintain that temperature there. After the food is taken out, the occupancy sensor 31 detects the emptiness of the compartment inside and turns off the PN junction thermoelectric unit 37.

The forth compartment 40 has the same construction and equipment as the third compartment 30 has, except the PN junction thermoelectric unit 47 uses the reversed electric current flow which the PN junction thermoelectric unit of the third compartment 37 has. Because the Peltier Effect, the interior's temperature of the compartment will quickly raise to 140 degree F. and stays there. However, the third compartment 30 can be designed as a cold or a hot selectable compartment through a thermal switch 38 inside. The switch 38 has three positions, one is for the hot temperature, one is for the cold temperature and one is for the neutral, which the PN junction thermoelectric unit is not turned on.

Because the PN junction thermoelectric unit will create cold temperature on one side of the ceramic module, and the hot temperature on the other side, therefore, it is an option to have the cold compartment and the hot compartment share one PN junction thermoelectric unit. For example, the compartments 30 and 40 share one PN junction thermoelectric unit, when the thermo unit is turned on, it will maintain a warm compartment 30 and a cool compartment 40 simultaneously.

The lowest level compartment 50 has similar equipments and structure as the second compartment 20 but has a much larger space inside. And for cost saving purpose, instead of installing one alarm in each compartment, all installed compartments can share one alarm installed on the top panel 11.

In a standalone model, the iBOX won't need to connect to Internet or a home computer. Instead of using the host computer or a home PC to store captured video/audio data, the iBOX uses compact flash memory module to store the captured data. It will download the captured audio/video data into the plug-in flash memory, one is provided and installed by the iBOX user, and another one is provided for delivery person. When the delivery person keys in the correct password, the iBOX will open the lens shelter door 14, at the same time, the delivery person should plug his memory module into the vacant memory slot while another memory slot has been installed with the iBOX user's memory module, The first video camera 13 will start to record images once it detects the motion of mailman it then stores all captured image and voice data simultaneously into both memory modules. After the delivery person put the package into the unlocked compartment and locks the door, he can remove his memory module from the memory slot, the lens shelter door 14 will be closed and the first video camera 13 stop recording. The delivery process has been captured into at least one frame of video image and/or voice recording with embedded date information, such as year, day, hour and minute, and the unique iBOX identification number are stored in both memory modules. Both the carrier and the iBOX user have one copy of the delivery image stored in the memory module as the proof of the delivery.

In the home PC based iBOX model, the iBOX is simply connected with the user's home PC through power line. All control signal or image or audio data are transmitted from iBOX through an adaptor, which convert audio/video signals to powerline, then from powerline by passing through a gateway or bridge which will convert powerline signals to Ethernet which the home PC connect through. In this design, the captured audio/video data from the first video camera can be transmitted and stored either in the home PC and/or in the flash memory module. The delivery person still plugs in his memory module to get a copy of captured video/audio data as his delivery proof.

If this home PC based iBOX is installed on the front door as the wall mount type, it can be connected with the Cat. 5, 5e or 6 structuring cabling system to the home PC, to get all audio/video recordings transmitted through as above mentioned.

Figure 2:
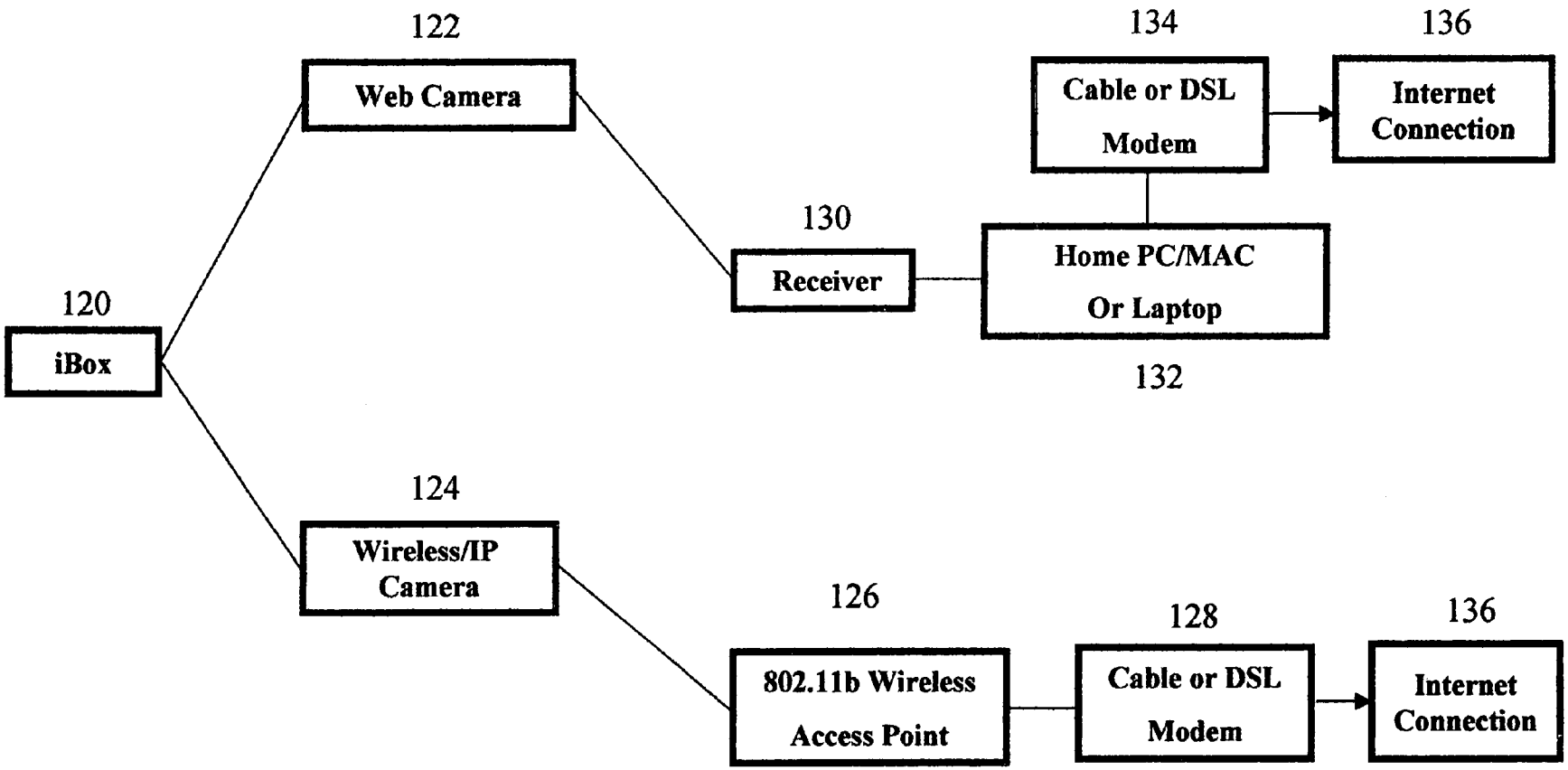
FIG. 2 illustrates the logical flow of the operation by different wireless video camera

In the network model, it depends the built-in intelligent of the camera, referring to FIG. 2, whether the camera will connect either to a Receiver 130 and the Home PC 132 (if it is a normal wireless web cam 122), or to the Access Point 126 directly (if use an wireless I.P. Camera 124, then no need to go through the Receiver and the home PC). The first wireless video camera in iBOX 120 works as the Transmitter, which will transmit the voice/video recordings to the receiver 130 and the home PC 132, or to an Access Point 126 directly. In either ways the voice/video images will be transmitted via DSL or Cable Modem 128 or 134 through Internet 136 to some designated e-mail addresses or web sites. Meantime, the system will page the iBOX user through the PSTN.

Figure 3:
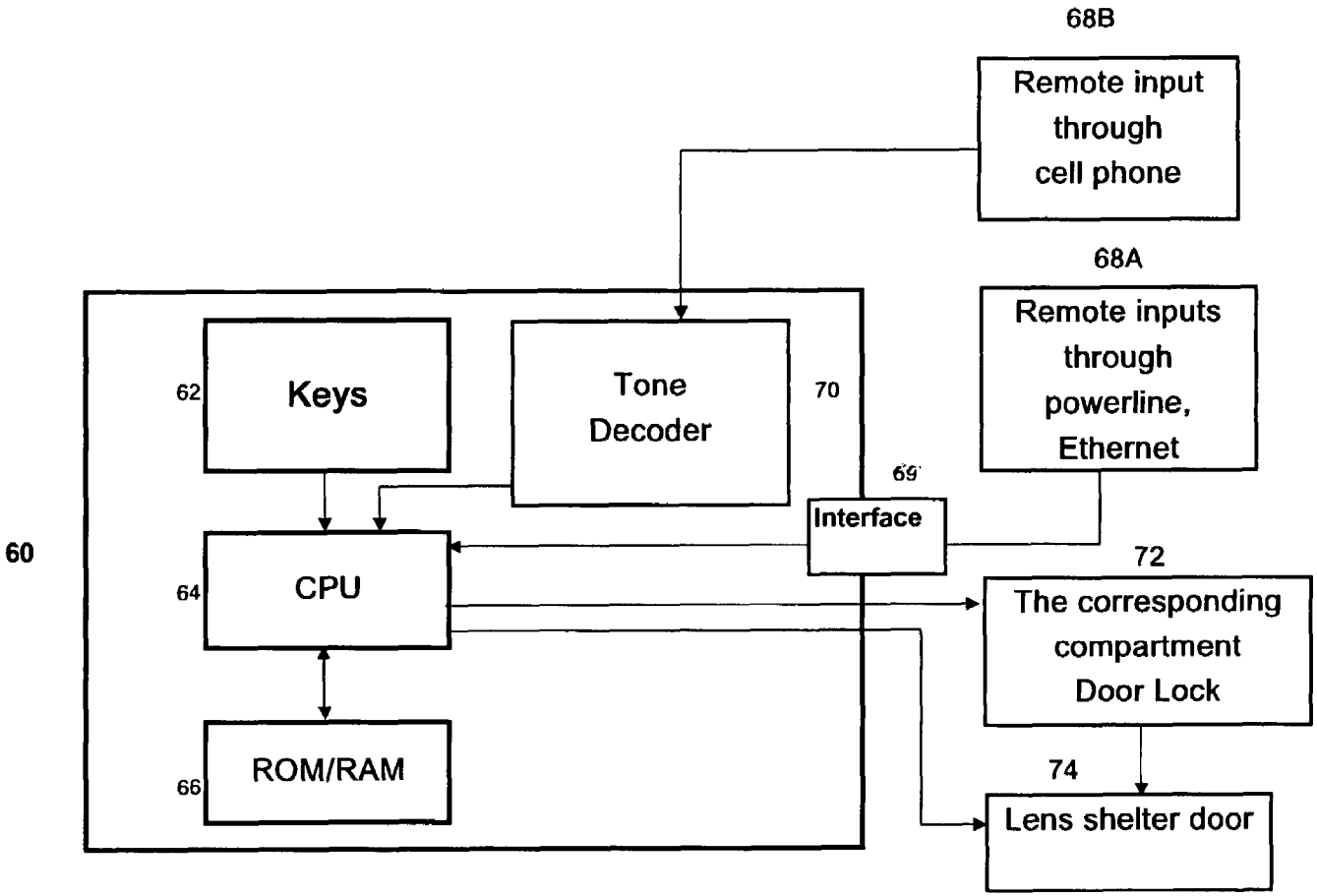
FIG. 3 illustrates the functional block diagram of the programmable keypad.

One important part of this invention is the programmable keypad. The keypad controls and interfaces with several other parts of this iBOX, such as unlock a corresponding compartment door, and turn on the shelter of camera to start the recording process. The keypad could have total 16 keys on it, among that 4 keys are set for the four different compartments, and the other 12 keys are numerical keys. A user can assign his new passwords to this keypad either locally from the keypad, if it is a stand-alone model, or remotely from the home PC or host computer, or even from the cell phone, if it is a network model. FIG. 3 illustrates the functional block diagram as to how a remote control keypad is possible. The keypad 60 has a CPU 64, a plurality of 16-keys 62, ROM/RAM module 66 to store instructions and passwords, and a plurality of interfaces for coupling with remote triggering inputs 68, where the command signals such as changing the passwords either transmitted from Ethernet or power line 68A, or wireless phone 68B etc. The network model iBOX has the capacity and the interface 69, using built-in IC, to convert the Internet signal through power line to keypad. The network model iBOX's keypad will carry an IP address from the DSL or cable modem, so that it can be addresed through Internet from remote PC or host computer. When a cell phone is used, the user can also get into the system to change the passwords by using the DTMF (Dual Tone Multiplex Frequency) technique. In this design, by adding a telephone tone encoder, one can direct the incoming call through the cordless phone receiver at home, instead of getting to fax machine, or normal phone handset, but to the iBOX. In this case, the iBOX has a handset-alike tone decoder 70 to pick up the telephone tone of the password from the receiver when the user key in, and generate a pulse to the CPU of keypad, as a result, one can change the password through the cell phone at his wishes. All technologies described above will allow the user to preset or reprogram his designated passwords to the keypad as the remote inputs either from 68A or 68B. Once a password was keyed in at the 16-keys 62, the CPU 64 will check if this password is valid by comparing to the preset password list stored in the ROMAAM module 66, if it is a valid one, the CPU 64 will send signal through the interface to the compartment door lock 72 to unlock the door, or to open the lens shelter door 74 of the first video camera.

As part of the overall system, an Internet-based iBOX through a PC or wireless Access Point at home can connect with the Host computer of service provider through ISDN, PSTN or Internet. The Host Computer has much larger capacity in hard disc storage, it can share the Home PC to record and save the pictures if the latter one has limited space for recordings.

Figure 4:
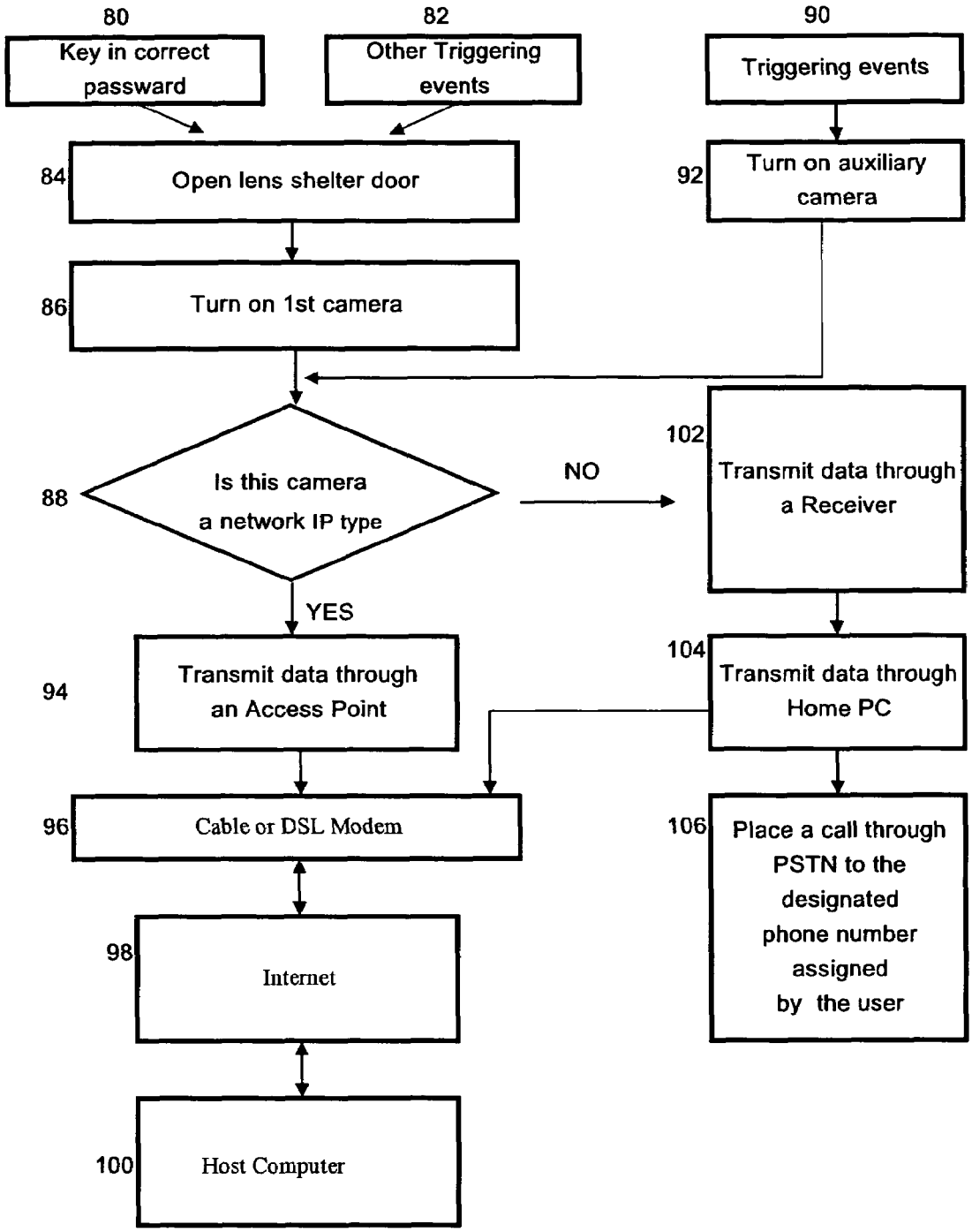
FIG. 4 illustrates the logical flow of the operation of an Internet-based iBOX.

FIG. 4 illustrates how an Internet-based iBOX and its overall network work. Once the system detects one of these triggering events Step 80 or 82 happened, whether a valid password is keyed in or some specific condition is met. The system opens the lens shelter door Step 84 and the first camera starts to record the images Step 86. Depends on the type of the first video camera, if the camera is a network IP type camera Step 88, it will transmit the data out through an Access Point 94 installed at the user's home directly. If it is a web type camera, the camera transmits the captured video or audio data through a receiver Step 102, then through the connected home PC Step 104 to the Cable or DSL Modem Step 96. If the iBOX has auxiliary camera installed inside the compartment, the package put inside will provide a trigger event Step 90 to turn on the auxiliary camera Step 92, and send that picture to the first camera. In either case, the captured recordings will be sent by the Cable or DSL Modem Step 96, which further forwards the data through Internet Step 98 to the host computer Step 100. In addition, by designating a pre-set phone number, the Home PC Step 104 will page the iBOX user to inform the delivery Step 106. If the user has instantly access a PC through the Internet connection he can download and view the on-line image captured by the first camera, or talk to and or see the delivery person on-line.

The system keeps the captured image for a certain period of time. Therefore, a user or the carrier can request to retrieve the dated image from the host computer later as a receipt.

The iBOX and its operating system can be implemented in the real world in many different forms as following examples:

a. Carriers Deliver a Registered Mail or Package that Requires a Confirmation of Delivery.

In addition to the passwords assigned by the particular iBOX user, the iBOX can have a common password assigned by the service provider. For example, if the Post Office is the carrier, the Post Office has a list of local iBOX users and gets a common password from the service provider, so that the mail carrier can use a common password to access all local iBOXes. Other carrier by contacting the service provider will receive a specific password before the delivery actually takes place. The common password can override the personal passwords. Both the common passwords and the personal passwords are kept strictly confidential and only authorized third party can request and access to the password. If needed, the service provider can remotely change the common passwords periodically through Internet, or even set temporarily password which is valid for two hours only through the cell phone for instant delivery.

When the delivery person approaches the iBOX or he keys in the correct password on the keypad, the iBOX will open the lens shelter door. Depends on the models of the iBOX, if the iBOX is a standalone model or a home PC-based model, the delivery person can plug in his memory module into the vacant memory slot to download the audio/video data from the first camera when recording starts. In the Internet-based iBOX, actually it is optional to use the memory module method to store the video/audio data; the system will store the captured image into the home PC and/or the host computer through Internet. At the same time, the correct password input will unlock the door of the designated compartment. Instantly, the bell-ring 23 is on and makes ringing alarm to remind the door is opened. At this moment, the deliverer stands in front of the first camera and he can show the packing slip of the parcel or mail onto the video camera 13 at least once, then he puts the parcel into the designated compartment, or the deliverer can speak to the first camera to identify who he is and what is the package. In the standalone model or the home PC-based model, the captured data will be put into the memory module or the home PC whether the data is from the first video camera or from the optional auxiliary camera inside the compartment.

However, for an Internet-based iBOX, all the dated voice/video recordings are transmitting on-line. After the goods are put inside the compartment, the occupancy sensor 21 lights up the corresponding LED indicator 15A on the angled top shelf control panel. The picture of lighting up this Indicator will be recorded and sent by video camera 13 through the system to give another indication that the goods is put inside. Then the deliverer shuts the compartment door, which will trigger the door switch 24 to closes the lens shelter 14 and terminates the recording of the first camera. 13. In this stage, the optional auxiliary camera 25 can still send the picture showing the parcel inside the compartment through the first video camera 13 modules to the system. Meantime, for the Internet-based iBOX model, the audio/video recordings will be transmitted to either Home PC or upload directly through the Internet to the host computer, or to any e-mail address or web site whoever needs those recordings as the evidence of delivery. It will also page the cell phone of the iBOX user to inform him there is a parcel for him. For a standalone model or the home PC-based model, the delivery person unplugs and takes the memory module with downloaded data with him.

In this scenario, there is no longer a need for the signature of the receiver, because the captured video images, which includes the present of a deliverer, showing the packing slip, still picture of goods in the compartment, and the pictures the user takes out the goods all can be used as a proof of delivery and receiving of the package.

The system can also be set up to request the receiver to give reconfirmation the receipt of the mail/goods by e-mail next day. The image/picture stored in the Host Computer system will carry the specific date and time for a pre-defined time period, when it is needed, the particular dated image can be retrieved from the memory module, the home PC or the host computer to provide evidence of delivery and receipt. Any out of date recording data will be automatically erased after a pre-defined time period.

b. The iBOX User Purchases Goods from Internet.

The iBOX user advises the seller his shipping address, the iBOX number and the password for the fifth compartment 50 when he places an order over the phone or Internet. Then the merchant arranges the shipping with a carrier. The seller put all that information including shipping address, iBOX password on the shipping label of the package for delivery.

The delivery person uses that password to access the fifth compartment of the user's iBOX, which invoking all operating processes depends on the type of the iBOX. Nevertheless, there is at least one frame of the delivery processes, such as the presence of the delivery person, the package or his voice input will be stored in the memory module, the home PC or the host computer of the service provider. Later on the carrier can download the captured images from the delivery person's memory module, or from the host computer through Internet, and stored the data in his own system for a period of time as the evidence of delivery and receipt.

Because the space of the fifth compartment is known, if the receiving package is too big to put in the iBOX, the carrier can arrange a traditional delivery with the package receiver.

c. The iBOX User Orders Take-out Food Delivery.

The iBox user can use the iBOX to receive the delivery of the hot or cold food. When an iBOX user calls and places an order, depends on the storage temperature requirement for the particular item, the user can give the store his address and the password for accessing the corresponding compartment to his iBOX. The food store delivery person uses that password on the keypad 12 to unlock the compartment door and put the item into the corresponding compartment. In case of the delivery of an ice cream cake, it is not necessary for the iBOX user waiting at home, the ice cream delivery person keys in the password for the cold food compartment, open the door and put the ice cream in. Meantime, the occupancy sensor 31 of the third compartment 30 inside will activate the PN cooling system 37 and quickly reduce the temperature inside the compartment down to 42 degree F. and maintains the temperature there, until the user takes it out, the food will stay cool and fresh, and ready for eating. The operating process is the same for a warm food delivery, where the forth compartment is accessed.

Even if the delivery person without having the password aforehead, he can call the user cell phone to get one. The iBOX user can instantly make a call to the system to set a temporarily password for him to open certain compartment to put goods in.

This invention also provide a much secured multifunction mailbox where any unauthorized intrusion will be deterred because the built-in video recording capacity. Therefore, to keep this password system simple and safe, there is an option that the iBOX user can renew it momentarily either on-site or re-program it through Internet or cell phone if he chose to do so. The stored video/audio data can be purged periodically. The service provider or the home PC owner can decide how often the purge should happen.

Since iBOX has video recording and transmission capability, if this iBOX is installed nearby the front door, it can also be used as the video surveillance purpose. In this case, the iBOX will be connected to the doorbell, or even embedded with a doorbell inside. When the mailman or visitor push the door bell, it will actuate the system, so that either the people in the house, or outside the road or office can see through his video phone, TV, Home PC or 3G mobile phone, to get know who is standing on the front of his home, or speak to him.

I claim:

1. An intelligent multifunctional mailbox having an unique identification number (ID) comprising:

a main case having at least one built-in regular compartment;

a control panel located at easy accessible top portion of the case, wherein the panel comprising:

a programmable keypad;

at least one LED status light;

a first video camera;

a first connector providing interface for all wires and power of the compartment;

means for storing the captured video/audio data from the camera;

at least one stackable secured module compartment having a door with magnetic door lock controlled by the programmable keypad through assigned passwords;

means for sounding alarm while the door is opened;

an optional auxiliary camera;

an occupancy sensor coupling to the control panel;

an optional means for controlling compartment temperature coupling to the occupancy sensor;

a plurality of second connectors, which are the complementary of the first connector and connect the wires and power between the main case and the secured module compartments; and a power line.

2. The mailbox claimed as claim 1, wherein means for storing the captured video/audio data from the camera further comprising a plurality of connecting slots where a memory device can be plugged in to receive the video/audio data captured by the first camera.

3. The mailbox claimed as claim 1, wherein means for storing the captured video/audio data from the camera further comprising a plurality of connecting slots where a memory device can be plugged in to receive the video/audio data captured by the first camera and the optional auxiliary camera.

4. The mailbox claimed as claim 2 or 3, wherein the plurality of connecting slots where the memory device can be plugged in to receive the video/audio data captured by the first camera further comparing:

the connecting slots using USB interface protocol; and the memory device is a compacted flash memory module.

5. The mailbox claimed as claim 4, wherein the plurality of connecting slots where the memory device can be plugged in to receive the video/audio data captured by the first camera further comparing of two USB interfaces.

6. The mailbox claimed as claim 1, wherein an optional means for controlling compartment temperature further comprising:

a temperature control device controlling by the occupancy sensor;

if the sensor detecting the presence of item inside the compartment then means for turns on the temperature control device which invokes a temperature pump to work; and, means for bringing the compartment interior temperature to a desire temperature range and maintaining that temperature range.

7. The mailbox claimed as claim 6, the temperature pump is a built-in miniature NP junction thermoelectric unit.

8. The mailbox claimed as claim 5, wherein an optional means for controlling compartment temperature further comprising:

a switch offering a plurality of selections to select from a plurality temperature ranges;

a temperature control device controlling by the occupancy sensor, wherein only if the sensor detecting the presence of item inside the compartment, then sensor turns on the temperature device which invokes a temperature pump to work; and means for bringing the compartment interior temperature to a desire temperature range and maintaining temperature within that temperature range.

9. The mailbox claimed as claim 7, wherein a switch offering a plurality of selections to select from a plurality temperature ranges further comprising two selections where one selection is for a hot temperature range and another is for a cold temperature range.

10. The mailbox claimed as claim 7, wherein a switch offering a plurality of selections to select from a plurality temperature ranges further comprising three selections where one selection is for a hot temperature range and one is for a cold temperature range and one is to turn the temperature pump off.

11. The mailbox claimed as claim 1, wherein the programmable keypad further comprising:

means for assigning a new password through the keypad for each corresponding secured module compartments;

means for opening the lock of the corresponding secured module compartment when a user keying in the correct password; and means for starting the recording by the first camera.

12. The mailbox claimed as claim 11, wherein the programmable keypad further comprising:

means for reading a identification card; and means for verifying the identification card and the key-in password to unlock the door of the corresponding secured module compartment.

13. The mailbox claimed as claim 11, the means for starting recording and means for storing the captured video/audio data further comprising:

means for capturing the video/audio data by the first camera; and means for storing the capturing data simultaneously in both of plugged-in memory module.

14. The mailbox claimed as claim 11, where the means for starting the recording by the camera further comprising:

means for capturing video/audio data by the first camera; and means for capturing video data by the optional auxiliary second camera inside of monitored compartment.

15. The mailbox claimed as claim 8, wherein the means for capturing video/audio data further comprising:

means for embedding date, such as year, month, day, hour, minute, second information within the captured video/audio data; and means for embedding the iBOX's ID within the captured video/audio data.

16. The mailbox claimed as claim 1, wherein the occupancy sensor coupling to the control panel further comprising:

if the sensor detecting item inside the compartment, means for turning the corresponding LED status light on; and if the sensor detecting no item inside the compartment, means for turning the corresponding LED status light off.

17. The mailbox claimed as claim 1, where the means for sounding alarm while the door is opened further comprising:

an alarm installed inside the compartment coupling with the compartment door locking mechanism;

means for sounding the alarm if the door is opened; and means for turning off the alarm if the door is locked.

18. The mailbox claimed as claim 1, where the means for alarming while the door is opened further comprising:

one alarm installed with the mailbox;

the alarm is shared and coupling with the locking mechanism of all installed secured module compartments, means for sounding the alarm if any one door of these secured module compartments is opened; and means for turning off the alarm if the door is locked.

19. An intelligent multifunctional mailbox comprising:

a case having at least one built-in regular compartment with one door;

means for communicating with a remote device;

a main case having at least one built-in regular compartment;

a control panel located at easy accessible top portion of the case, wherein the panel comprising:

a programmable keypad whose password can be assigned locally or remotely;

at least one LED status light;

a first video camera;

a first connector providing interface for all wires and power of the compartment;

means for storing the captured video/audio data from the camera;

at least one stackable secured module compartment having a door with magnetic door lock controlled by the programmable keypad;

means for sounding alarm while the door is opened;

an optional auxiliary camera;

an occupancy sensor coupling to the control panel;

an optional means for controlling compartment temperature coupling to the occupancy sensor;

a plurality of second connectors, which are the complementary of the first connector and connect the wires and power between the main case and the secured module compartments; and a power line.

20. The mailbox claimed as claim 19, wherein the means for communicating with the remote device further comprising means for transmitting and receiving data and control signals with the remote device through powerline.

21. The mailbox claimed as claim 20, wherein the means for transmitting and receiving data and control signals with the remote device through powerline further comprising:

means for transmitting the video/audio data captured by the first camera to the remote device; and means for receiving control signals regarding to password assignment from the remote device.

22. The mailbox claimed as claim 21, wherein the means for receiving password from the remote device further comprising:

means for receiving password assignment for a specified compartment from the remote device; and means for storing the received password.

23. The mailbox claimed as claim 22, wherein the means for receiving password assignment for a specified compartment from the remote device further means for receiving password assignment from a wireless phone.

24. The mailbox claimed as claim 23, wherein the means for receiving password assignment for a specified compartment from the remote device further means for receiving password assignment from a remote computer.

25. The mailbox claimed as claim 20, wherein the means for receiving control signals regarding to password assignment from the remote device further means receiving control signals through the powerline transmission.

26. The mailbox claimed as claim 20, wherein the means for receiving control signals regarding to password assignment from the remote device further means receiving control signals through a wireless transmission.

27. The mailbox claimed as claim 20, wherein the means for storing the video/audio data captured by the first video camera further comprising:

means for storing the captured video/audio data locally; and means for storing the captured video/audio data at the remote device.

28. The mailbox claimed as claim 27, wherein means for storing the captured video/audio data further comprising at least one connecting slot where a memory device can be plugged in to receive the captured video/audio data from the camera.

29. The mailbox claimed as claim 28, wherein at least one connecting slot where the memory device can be plugged in to receive the captured video/audio data from the camera further comparing:

the connecting slot using USB interface protocol; and the memory device is a compacted flash memory module.

30. The mailbox claimed as claim 28, wherein means for storing the captured video/audio data from the camera further comprising a plurality of connecting slots where a memory device can be plugged in to receive the video/audio data captured by the first camera.

31. The mailbox claimed as claim 28, wherein means for storing the captured video/audio data from the camera further comprising a plurality of connecting slots where a memory device can be plugged in to receive the video/audio data captured by the first camera and the optional auxiliary camera.

32. The mailbox claimed as claim 19, wherein an optional means for controlling compartment temperature further comprising:

a temperature control device controlling by the occupancy sensor;

if the sensor detecting the presence of item inside the compartment then means for turns on the temperature control device which invokes a temperature pump to work; and, means for bringing the compartment interior temperature to a desire temperature range and maintaining that temperature range.

33. The mailbox claimed as claim 32, the temperature pump is a built-in miniature NP junction thermoelectric unit.

34. The mailbox claimed as claim 19, wherein an optional means far controlling compartment temperature further comprising:

a switch offering a plurality of selections to select from a plurality temperature ranges;

a temperature control device controlling by the occupancy sensor, wherein only if the sensor detecting the presence of item inside the compartment, then sensor turns on the temperature device which invokes a temperature pump to work; and means for bringing the compartment interior temperature to a desire temperature range and maintaining temperature within that temperature range.

35. The mailbox claimed as claim 34, wherein the switch offering the plurality of selections to select from the plurality temperature ranges further comprising two selections where one selection is for a hot temperature range and another is for a cold temperature range.

36. The mailbox claimed as claim 35, wherein the switch offering the plurality of selections to select from the plurality temperature ranges further comprising three selections where one selection is for a hot temperature range and one is for a cold temperature range and one is to turn the temperature pump off.

37. The mailbox claimed as claim 19, wherein the programmable keypad further comprising:

means for assigning a new password through the keypad for each corresponding secured module compartments;

means for opening the lock of the corresponding secured module compartment when a user keying in the correct password;

means for opening the lens shelter door; and means for starting the recording by the first video camera.

38. The mailbox claimed as claim 37, where the means for starting the recording by the first video camera further comprising:

means for capturing the video/audio data from the first camera; and means for capturing the video data from the optional auxiliary second camera.

39. The mailbox claimed as claim 38, wherein the means fur capturing video/audio data further comprising:

means for embedding date, such as year, month, day, hour, minute, second information within the captured video/audio data; and means for embedding the iBOX's ID within the captured video/audio data.

40. The mailbox claimed as claim 19, wherein the occupancy sensor coupling to the control panel further comprising:

if the sensor detecting item inside the compartment, means for turning the corresponding LED status light on; and if the sensor detecting no item inside the compartment, means for turning the corresponding LED status light off.

41. The mailbox claimed as claim 19, where the means for sounding alarm while the door is opened further comprising:

an alarm installed inside the compartment coupling with the compartment door locking mechanism;

means for sounding the alarm if the door is opened; and means for turning off the alarm if the door is locked.

42. The mailbox claimed as claim 19, where the means for alarming while the door is opened further comprising:

one alarm installed with the mailbox;

the alarm is shared and coupling with the locking mechanism of all installed secured module compartments means for sounding the alarm if any one door of these secured module compartments is opened; and means for turning off the alarm if the door is locked.

43. The mailbox claimed as claim 19, wherein the means for communicating with the remote device further comprising means for transmitting and receiving data ad control signal to/from the remote device through wire and wireless communication.

44. The mailbox claimed as claim 43, the means for transmitting and receiving data and control signal to/from the remote device through wire and wireless communication further comprising:

means for transmitting the video/audio data captured by the first camera to the remote device; and means for receiving control signals from the remote device.

45. The mailbox claimed as claim 43, the means for transmitting and receiving data and control signal with the remote device through wire and wireless communication further comprising:

means for transmitting the video/audio data captured by the first camera and by the auxiliary camera to the remote device; and means for receiving control signals from the remote device.

46. The mailbox claimed as claim 45, the means for receiving password from the remote device further comprising:

means for receiving password assignment for a specified compartment from the remote device; and means for storing the received password.

47. The mailbox claimed as claim 46, wherein the means for storing the video/audio data captured by the first video camera further comprising:

means for storing the captured video/audio data locally; and means for storing the captured video/audio data at the remote device.

48. The mailbox claimed as claim 47, wherein means for storing the captured video/audio data further comprising at least one connecting slot where a memory device can be plugged in to receive the captured video/audio data from the camera.

49. The mailbox claimed as claim 48, wherein at least one connecting slot where the memory device can be plugged in to receive the captured video/audio data from the camera further comparing:

the connecting slot using USB interface protocol; and the memory device is a compacted flash memory module.

50. The mailbox claimed as claim 48, wherein means for storing the captured video/audio data from the camera further comprising a plurality of connecting slots where a memory device can be plugged in to receive the video/audio data captured by the first camera.

51. The mailbox claimed as claim 48, wherein means for storing the captured video/audio data from the camera further comprising a plurality of connecting slots where a memory device can be plugged in to receive the video/audio data captured by the first camera and the optional auxiliary camera.

52. The mailbox claimed as claim 43, wherein an optional means for controlling compartment temperature further comprising:

temperature control device controlling by the occupancy sensor;

if the sensor detecting the presence of item inside the compartment then means for turns on the temperature control device which invokes a temperature pump to work; and means for bringing the compartment interior temperature to a desire temperature range and maintaining that temperature range.

53. The mailbox claimed as claim 52, wherein the temperature pump is a built-in miniature NP thermoelectric unit.

54. The mailbox claimed as claim 43, wherein an optional means for controlling compartment temperature further comprising:

a switch offering a plurality of selections to select from a plurality temperature ranges;

a temperature control device controlling by the occupancy sensor, wherein only if the sensor detecting the presence of item inside the compartment, then sensor turns on the temperature device which invokes a temperature pump to work; and means for bringing the compartment interior temperature to a desire temperature range and maintaining temperature within that temperature range.

55. The mailbox claimed as claim 54, wherein the switch offering the plurality of selections to select from the plurality temperature ranges further comprising two selections where one selection is for a hot temperature range and another is for a cold temperature range.

56. The mailbox claimed as claim 55, wherein the switch offering the plurality of selections to select from the plurality temperature ranges further comprising three selections where one selection is for a hot temperature range and one is for a cold temperature range and one is to turn the temperature pump off.

57. The mailbox claimed as claim 43, wherein the programmable keypad further comprising:

means for assigning a new password through the keypad for each corresponding secured module compartments;

means for opening the lock of the corresponding secured module compartment when a user keying in the correct password;

means for opening the lens shelter door; and means for starting the recording by the first video camera.

58. The mailbox claimed as claim 57; where the means for starting the recording by the first video camera further comprising:

means for capturing the video/audio data from the first camera; and means for capturing the video data from the optional auxiliary second camera.

59. The mailbox claimed as claim 58, wherein the means for capturing video/audio data further comprising:

means for embedding date, such as year, month, day, hour, minute, second information within the captured video/audio data; and means for embedding the iBOX's ID within the captured video/audio data.

60. The mailbox claimed as claim 43, wherein the occupancy sensor coupling to the control panel further comprising:

if the sensor detecting item inside the compartment, means for turning the corresponding LED status light on; and if the sensor detecting no item inside the compartment, means for turning the corresponding LED status light off.

61. The mailbox claimed as claim 43, where the means for sounding alarm while the door is opened further comprising:

an alarm installed inside the compartment coupling with the compartment door locking mechanism;

means for sounding the alarm if the door is opened; and means for turning off the alarm if the door is locked.

* * * * *